US012807286B2

(12) United States Patent
Hamada

(10) Patent No.: US 12,807,286 B2
(45) Date of Patent: Nov. 24, 2026

(54) SYSTEM FOR AND METHOD OF CONTROLLING BEHAVIOR OF WATERCRAFT

(71) Applicant: YAMAHA HATSUDOKI KABUSHIKI KAISHA, Iwata (JP)

(72) Inventor: Satoru Hamada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 36 days.

(21) Appl. No.: 19/240,256

(22) Filed: Jun. 17, 2025

(65) Prior Publication Data

US 2025/0313316 A1 Oct. 9, 2025

Related U.S. Application Data

(63) Continuation-in-part of application No. 17/885,595, filed on Aug. 11, 2022, now Pat. No. 12,344,360.

(30) Foreign Application Priority Data

Sep. 6, 2021 (JP) ..... 2021-144773

(51) Int. Cl.

| | |
|---|---|
| ***B63B 79/40*** | (2020.01) |
| ***B63B 39/06*** | (2006.01) |
| ***B63B 79/10*** | (2020.01) |
| ***B63H 20/10*** | (2006.01) |
| ***B63H 21/21*** | (2006.01) |

(52) U.S. Cl.

CPC ..... *B63B 79/40* (2020.01); *B63B 39/06* (2013.01); *B63B 79/10* (2020.01); *B63H 20/10* (2013.01); *B63H 21/21* (2013.01); *B63B 2039/067* (2013.01); *B63H 2021/216* (2013.01)

(58) Field of Classification Search

CPC ... B63B 2039/067; B63B 39/06; B63B 79/10; B63B 79/40; B63H 20/10; B63H 2021/216

See application file for complete search history.

(56) References Cited

PUBLICATIONS

Hamada, "System for and Method of Controlling Behavior of Watercraft", U.S. Appl. No. 17/885,595, filed Aug. 11, 2022.

*Primary Examiner* — Charles J Han

(74) *Attorney, Agent, or Firm* — Keating & Bennett, LLP

(57) ABSTRACT

A system includes a marine propulsion device, an actuator, a sensor, and a controller. The sensor detects motion information indicating an up-and-down directional motion of a bow of a watercraft. The controller is configured or programmed to selectively set either a trim-up direction or a trim-down direction as a trim direction in accordance with the up-and-down directional motion of the bow based on the motion information. The controller is configured or programmed to control the actuator to cause the marine propulsion device to perform a trim motion in the trim direction, and to set a duration of the trim motion to be different between when the marine propulsion device is caused to perform the trim motion in the trim-up direction and when the marine propulsion device is caused to perform the trim motion in the trim-down direction.

13 Claims, 16 Drawing Sheets

SYSTEM FOR AND METHOD OF CONTROLLING BEHAVIOR OF WATERCRAFT

CROSS REFERENCE TO RELATED APPLICATIONS

This application claims the benefit of priority to Japanese Patent Application No. 2021-144773 filed on Sep. 6, 2021. The entire contents of this application are hereby incorporated herein by reference.

BACKGROUND OF THE INVENTION

1. Field of the Invention

The present invention relates to a system for and a method of controlling a behavior of a watercraft.

2. Description of the Related Art

Chances are that pitching movement called "porpoising" occurs during high-speed navigation of a watercraft with installation of a marine propulsion device such as an outboard motor. A main reason for the occurrence of porpoising is as follows.

In high-speed navigation of the watercraft, the bow of the watercraft is elevated by a lift. When the bow of the watercraft is elevated, the center of lift is shifted rearward such that a moment acts on the watercraft to lower the bow. Accordingly, the bow of the watercraft is lowered. When the bow of the watercraft is lowered, the center of lift is shifted forward such that a moment acts on the watercraft to elevate the bow. Accordingly, the bow of the watercraft is elevated. Repetition of the motions described herein results in the occurrence of porpoising of the watercraft, that is, repetition of elevation and lowering of the bow.

A reduction in the rotational speed of an engine has been known as a technology for alleviating porpoising. Alternatively, as described in Japan Patent Application Publication No. 2021-95072, controlling the posture of a watercraft by lowering a trim tab has been known as a technology for alleviating porpoising. Both the technologies for alleviating porpoising described above inevitably cause a reduction in the velocity of the watercraft.

SUMMARY OF THE INVENTION

Example embodiments of the present invention each inhibit a reduction in velocity of watercrafts, and simultaneously alleviate porpoising.

A system according to a first example embodiment of the present invention controls a behavior of a watercraft. The system includes a marine propulsion device, an actuator, a sensor, and a controller. The marine propulsion device includes a trim shaft. The marine propulsion device is attachable to the watercraft so as to be pivotable about the trim shaft. The actuator causes the marine propulsion device to perform a trim motion in a trim-up direction and a trim-down direction by causing the marine propulsion device to pivot about the trim shaft. The sensor detects motion information indicating an up-and-down directional motion of a bow of the watercraft. The controller is communicably connected to the actuator. The controller is configured or programmed to obtain the motion information, and selectively set either the trim-up direction or the trim-down direction as a trim direction in accordance with the up-and-down directional motion of the bow based on the motion information. The controller is configured or programmed to control the actuator to cause the marine propulsion device to perform the trim motion in the trim direction. The controller is configured or programmed to set a duration of the trim motion to be different between when the marine propulsion device is caused to perform the trim motion in the trim-up direction and when the marine propulsion device is caused to perform the trim motion in the trim-down direction.

A system according to a second example embodiment of the present invention controls a behavior of a watercraft. The system includes a posture control body, a first actuator, a sensor, and a controller. The posture control body is attachable to the watercraft and adjustable to change a position of the posture control body relative to the watercraft. The posture control body is configured to change a lift force acting on the watercraft by changing the position. The first actuator moves the posture control body in a first increasing direction to increase the lift force and in a first decreasing direction to decrease the lift force. The sensor detects motion information indicating an up-and-down directional motion of a bow of the watercraft. The controller is communicably connected to the first actuator. The controller is configured or programmed to obtain the motion information, and selectively set either the first increasing direction or the first decreasing direction as a movement direction of the posture control body in accordance with the up-and-down directional motion of the bow based on the motion information. The controller controls the first actuator to move the posture control body in the movement direction. The controller is configured or programmed to set a duration of moving the posture control body to be different between when the posture control body moves in the first increasing direction and when the posture control body moves in the first decreasing direction.

A system according to a third example embodiment of the present invention controls a behavior of a watercraft. The system includes a posture control body, a first actuator, a marine propulsion device, a second actuator, a sensor, and a controller. The posture control body is attachable to the watercraft and adjustable to change a position of the posture control body relative to the watercraft. The posture control body is configured to change a lift force acting on the watercraft by changing the position. The first actuator moves the posture control body in a first increasing direction to increase the lift force and in a first decreasing direction to decrease the lift force. The marine propulsion device is attachable to the watercraft and adjustable to change a position of the marine propulsion device relative to the watercraft. The second actuator moves the marine propulsion device in a second increasing direction to increase the lift force and in a second decreasing direction to decrease the lift force. The sensor detects motion information indicating an up-and-down directional motion of a bow of the watercraft. The controller is communicably connected to the first actuator and the second actuator. The controller is configured or programmed to obtain the motion information, and alleviate porpoising of the watercraft by moving at least one of the posture control body and the marine propulsion device based on the motion information. When moving the posture control body, the controller is configured or programmed to selectively set either the first increasing direction or the first decreasing direction as a movement direction of the posture control body in accordance with the up-and-down directional motion of the bow, and control the first actuator to move the posture control body in the movement direction.

When moving the marine propulsion device, the controller is configured or programmed to selectively set either the second increasing direction or the second decreasing direction as a movement direction of the marine propulsion device in accordance with the up-and-down directional motion of the bow, and control the second actuator to move the marine propulsion device in the movement direction. The controller is configured or programmed to set a duration of moving the posture control body to be different between when the posture control body moves in the first increasing direction and when the posture control body moves in the first decreasing direction. The controller is configured or programmed to set a duration of moving the marine propulsion device to be different between when the marine propulsion device moves in the second increasing direction and when the marine propulsion device moves in the second decreasing direction.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
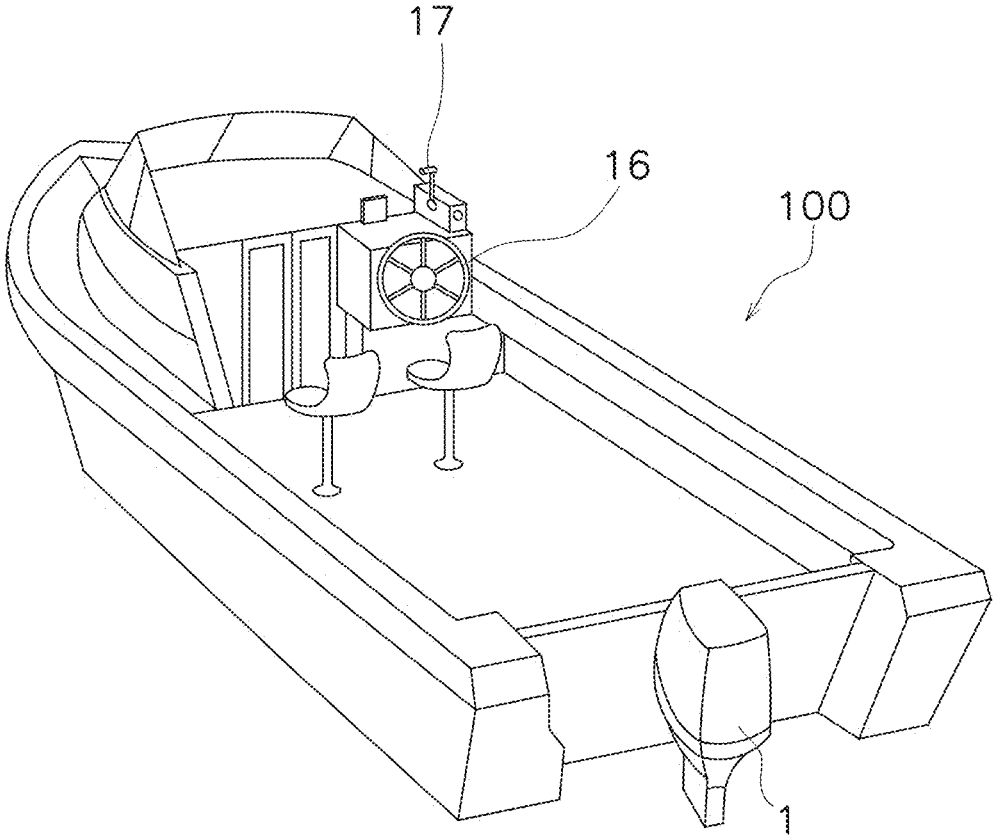
FIG. 1 is a perspective view of a watercraft according to a first example embodiment of the present invention.
Figure 2:
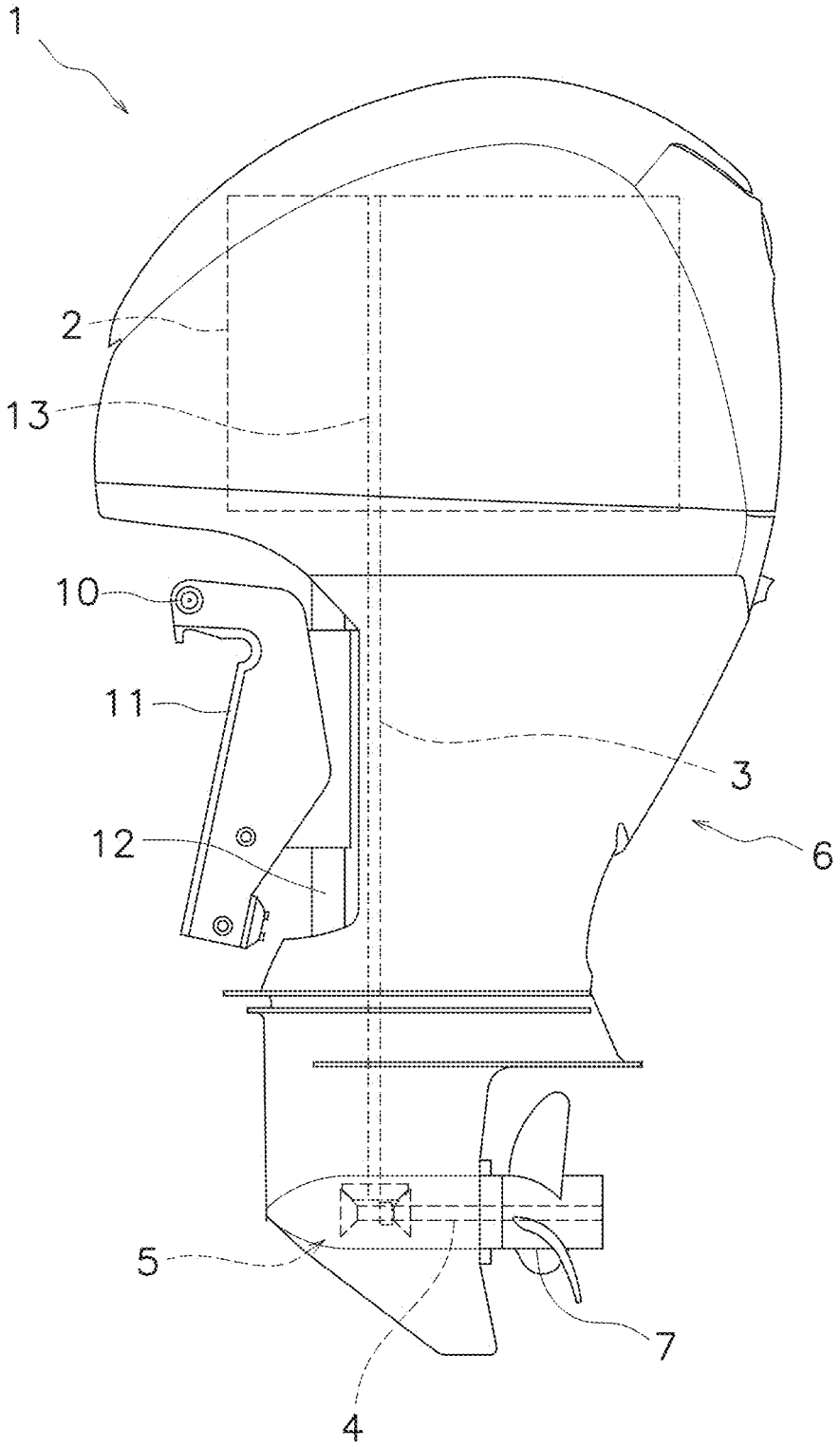
FIG. 2 is a side view of an outboard motor.

Example embodiments of the present invention will be explained with reference to drawings. FIG. 1 is a perspective view of a watercraft 100 according to a first example embodiment of the present invention. The watercraft 100 is provided with an outboard motor 1 attached to the stern thereof. The outboard motor 1 generates a thrust to propel the watercraft 100. FIG. 2 is a side view of the outboard motor 1. The outboard motor 1 is attached to the watercraft 100 by a bracket 11. The bracket 11 supports the outboard motor 1 such that the outboard motor 1 is rotatable about a trim shaft 10. The trim shaft 10 extends in a right-and-left direction of the outboard motor 1. The bracket 11 supports the outboard motor 1 such that the outboard motor 1 is rotatable about a steering shaft 12. The steering shaft 12 extends in an up-and-down direction of the outboard motor 1.

The outboard motor 1 includes a drive unit 2, a drive shaft 3, a propeller shaft 4, a shift mechanism 5, and a housing 6. The drive unit 2 generates the thrust to propel the watercraft 100. The drive unit 2 is, for instance, an internal combustion engine. The drive unit 2 includes a crankshaft 13. The crankshaft 13 extends in the up-and-down direction of the outboard motor 1.

The drive shaft 3 is connected to the crankshaft 13. The drive shaft 3 extends in the up-and-down direction of the outboard motor 1. The propeller shaft 4 extends in a back-and-forth direction of the outboard motor 1. The propeller shaft 4 is connected to the drive shaft 3 through the shift mechanism 5. A propeller 7 is attached to the propeller shaft 4. The shift mechanism 5 includes gears and a clutch to switch between forward movement and rearward movement. The shift mechanism 5 switches the direction of rotation transmitted from the drive shaft 3 to the propeller shaft 4. The housing 6 accommodates the drive unit 2, the drive shaft 3, the propeller shaft 4, and the shift mechanism 5.

Figure 3:
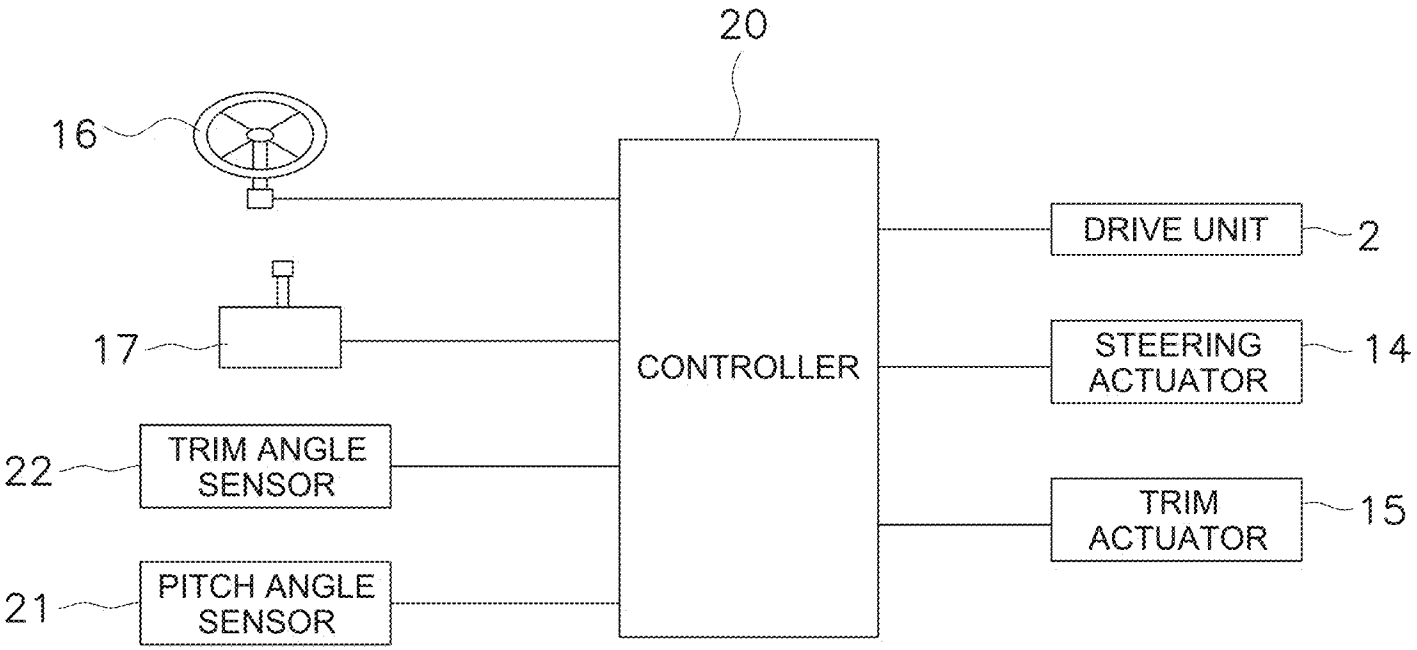
FIG. 3 is a schematic diagram for showing a configuration of a control system for the watercraft.

FIG. 3 is a schematic diagram for showing a configuration of a control system for the watercraft 100. As shown in FIG. 3, the outboard motor 1 includes a steering actuator 14 and a trim actuator 15. The steering actuator 14 rotates the outboard motor 1 about the steering shaft 12. The steering actuator 14 is, for instance, an electric motor. However, the steering actuator 14 may be another type of actuator such as an electric cylinder, a hydraulic motor, or a hydraulic cylinder.

The trim actuator 15 rotates the outboard motor 1 about the trim shaft 10. The trim actuator 15 is, for instance, an electric motor. However, the trim actuator 15 may be another type of actuator such as an electric cylinder, a hydraulic motor, or a hydraulic cylinder. The trim actuator 15 rotates the outboard motor 1 about the trim shaft 10 such that the outboard motor 1 is caused to perform a trim motion in a trim-up direction and a trim-down direction.

The control system includes a steering member 16 and a throttle operating member 17. The steering member 16 and the throttle operating member 17 are provided in a cockpit of the watercraft 100. The steering member 16 is operable by an operator to manipulate a turning direction of the watercraft 100. The steering member 16 includes, for instance, a steering wheel. However, the steering member 16 may include another member such as a joystick.

The throttle operating member 17 includes, for instance, a throttle lever. The throttle operating member 17 is operable by the operator to regulate the magnitude of the thrust generated by the outboard motor 1. The throttle operating member 17 is also operable by the operator to switch the direction of the thrust generated by the outboard motor 1 between forward and rearward directions.

The control system includes a controller 20. The controller 20 includes a processor such as a CPU and memories such as a RAM and a ROM. The controller 20 stores programs and data to control the outboard motor 1. The controller 20 may include a plurality of controllers provided as discrete components.

The controller 20 is communicably connected to the drive unit 2, the steering actuator 14, and the trim actuator 15. The controller 20 controls the drive unit 2 in accordance with the operation of the throttle operating member 17. The output rotational speed of the drive unit 2 is thus controlled. The controller 20 controls the steering actuator 14 in accordance with the operation of the steering member 16. The rudder angle of the outboard motor 1 is thus controlled.

The control system includes a pitch angle sensor 21 and a trim angle sensor 22. The pitch angle sensor 21 detects a pitch angle of the watercraft 100 and an angular velocity of the pitch angle (hereinafter referred to as "pitch angular velocity"). The pitch angle indicates a tilt angle in the up-and-down direction of the watercraft 100 relative to a horizontal direction. The pitch angle of the watercraft 100 and the pitch angular velocity thereof are exemplified as motion information indicating up-and-down directional motions of the bow of the watercraft 100.

The pitch angle sensor 21 includes, for instance, an IMU (Inertial Measurement Unit). The pitch angle sensor 21 outputs a pitch angle signal indicating the pitch angle of the watercraft 100 and the pitch angular velocity thereof. The trim angle sensor 22 detects a trim angle of the outboard motor 1. The trim angle indicates a rotational angle of the outboard motor 1 about the trim shaft 10 from a predetermined reference direction (e.g., vertical direction). The trim angle sensor 22 outputs a trim angle signal indicating the trim angle of the outboard motor 1.

Figure 4:
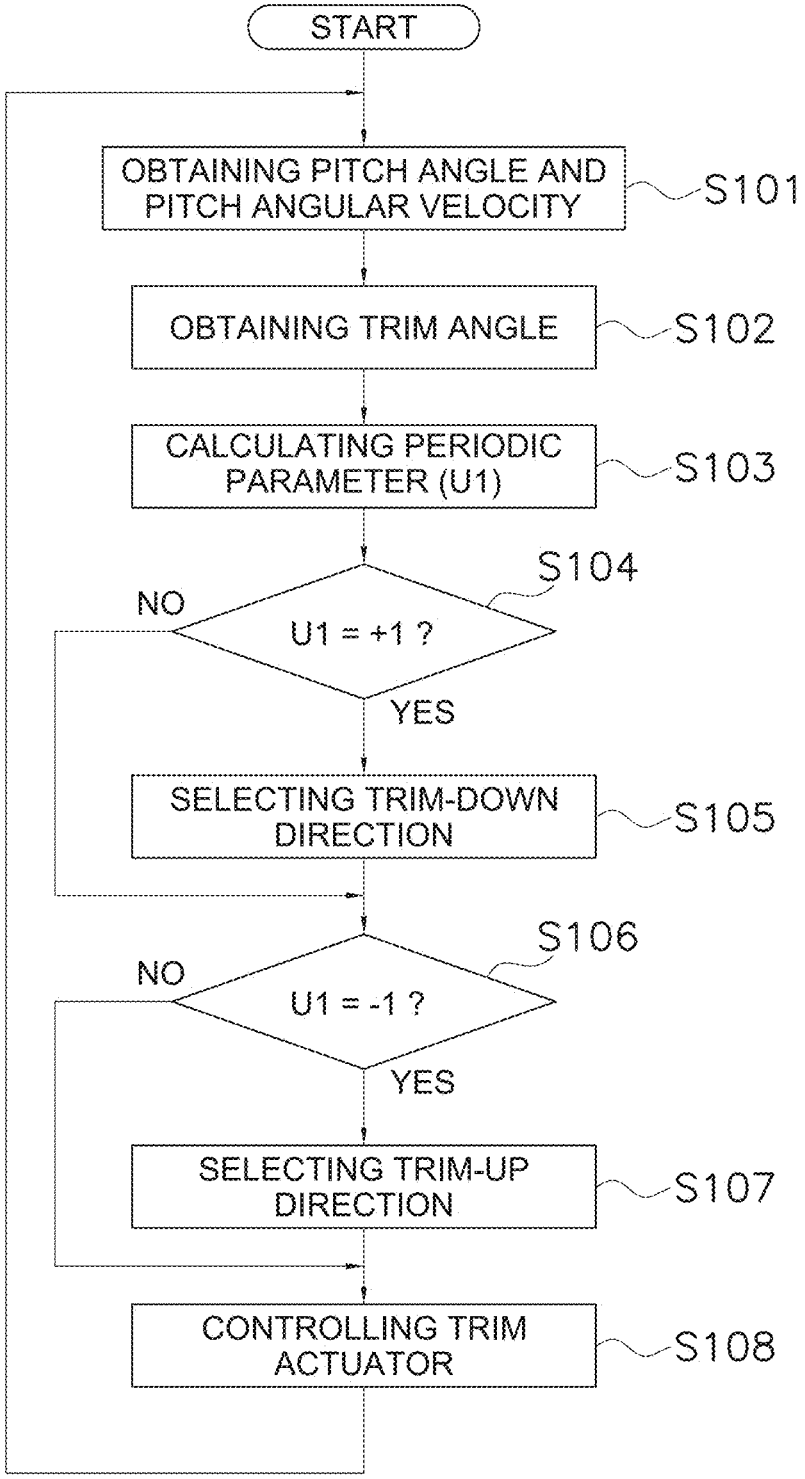
FIG. 4 is a flowchart for showing a series of processes of porpoising inhibiting control.

The controller 20 controls the trim motion based on the pitch angle of the watercraft 100, the pitch angular velocity thereof, and the trim angle of the outboard motor 1 to execute porpoising inhibiting control to inhibit porpoising. The porpoising inhibiting control will be hereinafter explained. FIG. 4 is a flowchart showing a series of processes of the porpoising inhibiting control.

As shown in FIG. 4, in step S101, the controller 20 obtains a pitch angle and a pitch angular velocity thereof. The controller 20 receives a pitch angle signal and obtains the pitch angle and the pitch angular velocity thereof from the pitch angle signal.

In step S102, the controller 20 obtains a trim angle. The controller 20 receives a trim angle signal and obtains the trim angle from the trim angle signal. In step S103, the controller 20 calculates a periodic parameter. The periodic parameter is a parameter calculated based on the pitch angle of the watercraft 100, the pitch angular velocity thereof, and the trim angle of the outboard motor 1. The value of the periodic parameter periodically varies with a variation in the pitch angle of the watercraft 100 and the pitch angular velocity thereof during the occurrence of porpoising of the watercraft 100. The periodic parameter is expressed by the following formula (1).

$$U1=a1\times(\theta p-\theta p^*)+a2\times d\theta p+a3\times(\theta t-\theta t^*) \quad (1)$$

"U1" indicates the periodic parameter. "θp" indicates the pitch angle of the watercraft 100. "dep" indicates the pitch angular velocity of the watercraft 100. "θt" indicates the trim angle of the outboard motor 1. "a1", "a2", and "a3" indicate predetermined coefficients that are set depending on the type and the state of the watercraft 100 and those of the outboard motor 1. "θp*" indicates an equilibrium pitch angle of the watercraft 100 during navigation. "θt*" indicates a target trim angle of the watercraft 100 during navigation. The periodic parameter periodically varies between −1 and +1 during the occurrence of porpoising of the watercraft 100.

In step S104, the controller 20 determines whether or not the periodic parameter is +1. When determining that the periodic parameter is +1, the controller 20 sets the trim-down direction as the trim direction in step S105.

In step S106, the controller 20 determines whether or not the periodic parameter is −1. When it is determined that the periodic parameter is −1, the controller 20 sets the trim-up direction as the trim direction in step S107.

In step S108, the controller 20 controls the trim actuator 15 to cause the outboard motor 1 to perform the trim motion in the trim direction. In other words, the controller 20 causes the outboard motor 1 to perform the trim motion in the trim-down direction when the periodic parameter becomes +1. Conversely, the controller 20 causes the outboard motor 1 to perform the trim motion in the trim-up direction when the periodic parameter becomes −1. The controller 20 repeatedly executes the processes in steps S101 to S108.

Figure 5:
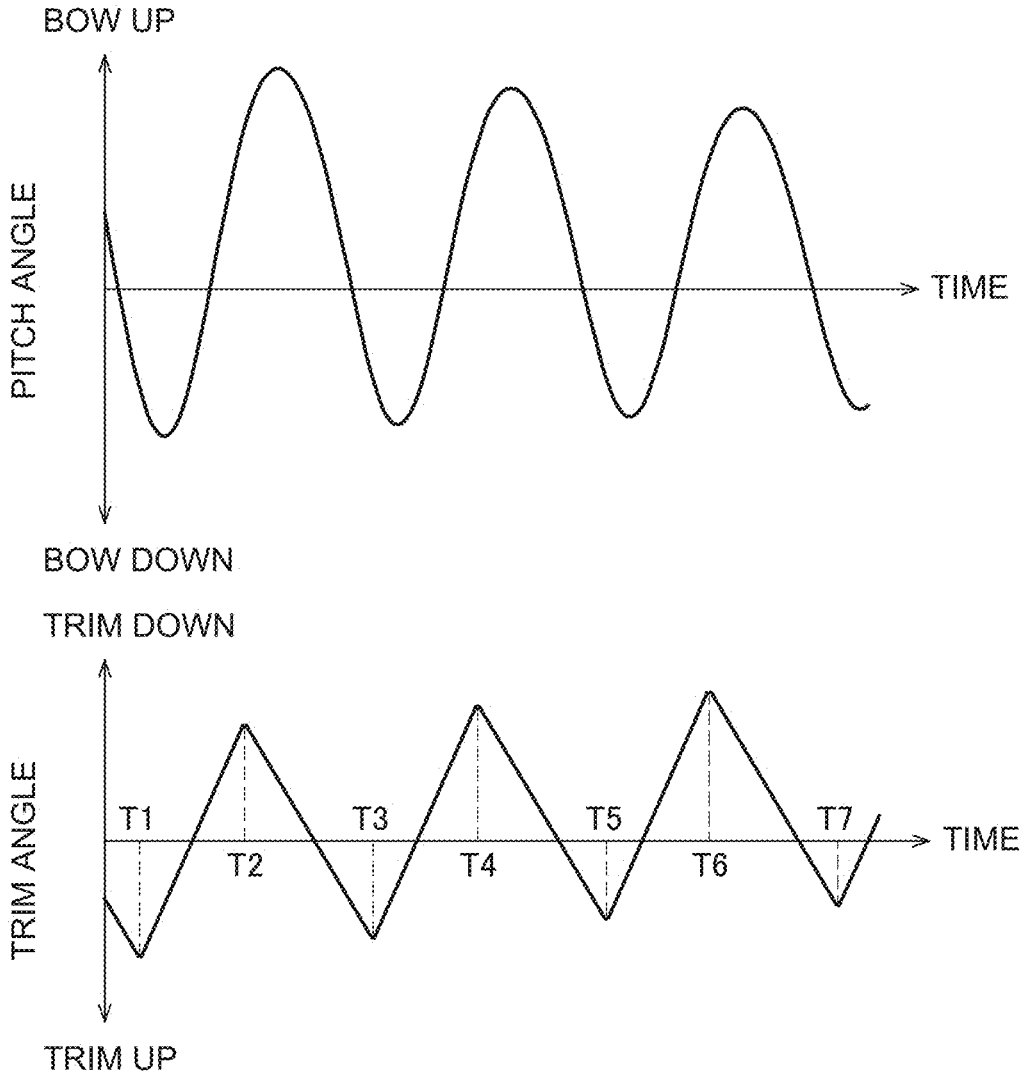
FIG. 5 includes a chart for showing variation in a pitch angle of the watercraft during the occurrence of porpoising and a chart for showing a variation in a trim angle caused by the porpoising inhibiting control.

FIG. 5 includes charts for showing a variation in a trim angle caused by the porpoising inhibiting control with respect to a variation in a pitch angle of the watercraft 100 during the occurrence of porpoising. As shown in FIG. 5, during the occurrence of porpoising, the pitch angle of the watercraft 100 varies periodically. At time T1, the controller 20 determines that the periodic parameter becomes +1. Based on this, the controller 20 causes the outboard motor 1 to perform the trim motion in the trim-down direction. The controller 20 causes the outboard motor 1 to perform the trim motion in the trim-down direction from time T1 to time T2.

At time T2, the controller 20 determines that the periodic parameter becomes −1. Based on this, the controller 20 causes the outboard motor 1 to perform the trim motion in the trim-up direction. The controller 20 causes the outboard motor 1 to perform the trim motion in the trim-up direction from time T2 to time T3.

Likewise, subsequently, the controller 20 causes the outboard motor 1 to perform the trim motion in the trim-down direction from time T3 to time T4. The controller 20 causes the outboard motor 1 to perform the trim motion in the trim-up direction from time T4 to time T5. The controller 20 causes the outboard motor 1 to perform the trim motion in the trim-down direction from time T5 to time T6. The controller 20 causes the outboard motor 1 to perform the trim motion in the trim-up direction from time T6 to time T7.

It should be noted that the controller 20 may execute the porpoising inhibiting control described above when a predetermined start condition is satisfied. The start condition indicates the occurrence of porpoising of the watercraft 100. For example, the start condition includes periodic variation in pitch angle at about 0.1 Hz or greater.

In the control system for the outboard motor 1 according to a first example embodiment of the present invention, either the trim-up direction or the trim-down direction is selectively set as the trim direction based on the pitch angle of the watercraft 100, the pitch angular velocity thereof, and the trim angle of the outboard motor 1. Because of this, the trim direction is able to be set by accurately determining the behavior of the watercraft 100 during the occurrence of porpoising. Then, the outboard motor 1 is caused to perform the trim motion in the set trim direction such that porpoising is alleviated. Consequently, a reduction in the velocity of the watercraft 100 is inhibited, and simultaneously porpoising is alleviated.

Figure 6A:
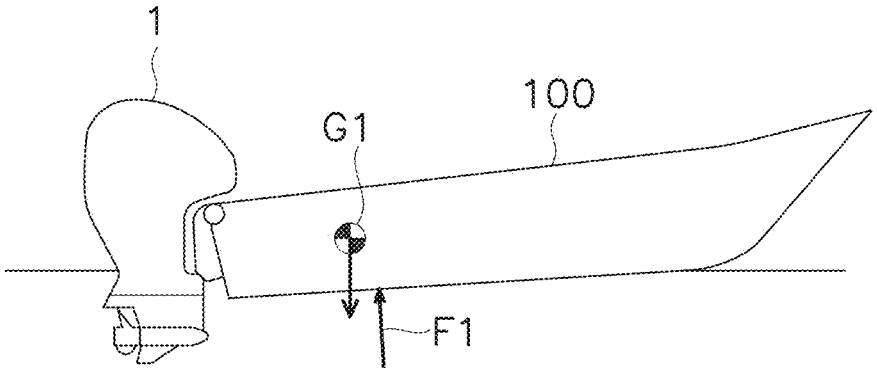
FIG. 6A is a diagram for showing an example of a behavior of the watercraft and a trim motion of the outboard motor during the occurrence of porpoising.
Figure 6B:
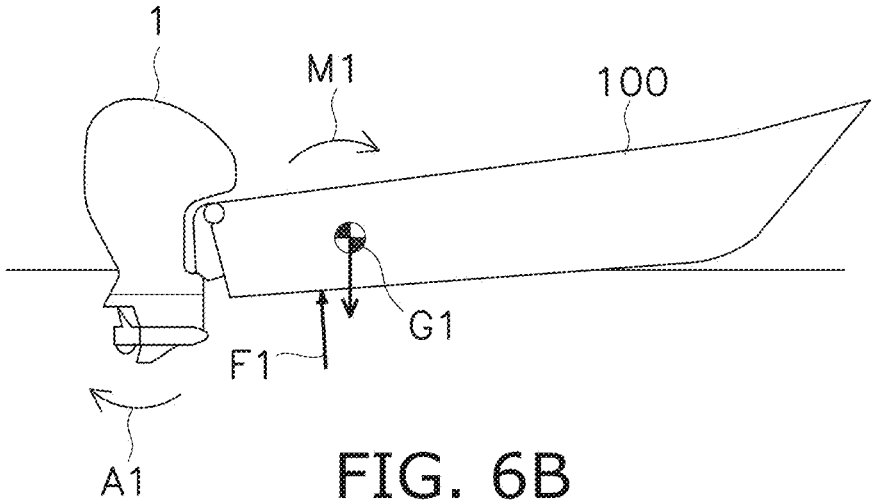
FIG. 6B is a diagram for showing the example of the behavior of the watercraft and the trim motion of the outboard motor during the occurrence of porpoising.
Figure 6C:
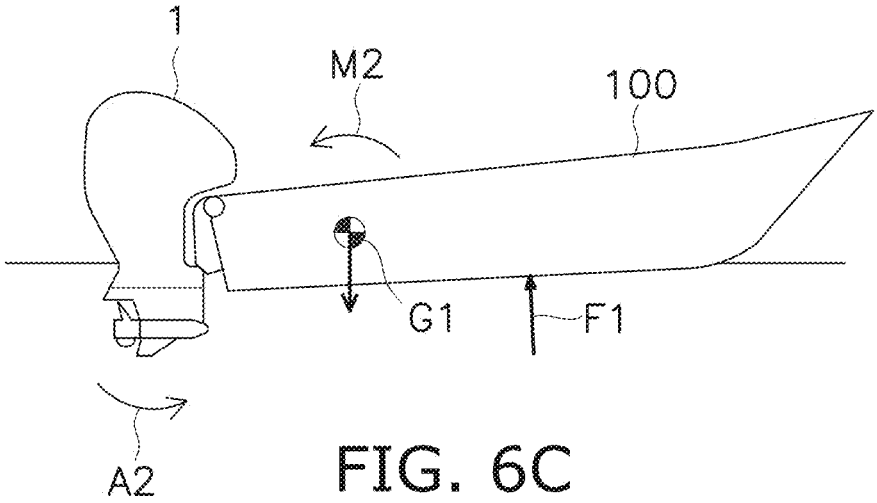
FIG. 6C is a diagram for showing the example of the behavior of the watercraft and the trim motion of the outboard motor during the occurrence of porpoising.

For example, FIGS. 6A to 6C are diagrams for showing an example of the behavior of the watercraft 100 and the trim motion of the outboard motor 1 during the occurrence of porpoising. During the occurrence of porpoising, as shown in FIG. 6A, a lift force F1 acts on a position forward of a center-of-gravity G1 of the watercraft 100 such that the bow of the watercraft 100 is elevated. When the bow of the watercraft 100 is elevated as shown in FIG. 6B, the position on which the lift force F1 acts is shifted aft of the center-of-gravity G1. Accordingly, a moment M1 acts on the watercraft 100 to lower the bow of the watercraft 100. At this time, during the porpoising inhibiting control, the controller 20 causes the outboard motor 1 to perform the trim motion in the trim-up direction as indicated by arrow A1. Accordingly, a moment, which is generated by the thrust of the outboard motor 1 and directed to elevate the bow of the watercraft 100, is increased in magnitude such that the moment M1 directed to lower the bow of the watercraft 100 is canceled out.

Conversely, when the bow of the watercraft 100 is lowered as shown in FIG. 6C, the position on which the lift force F1 acts is shifted forward of the center-of-gravity G1. Accordingly, a moment M2 acts on the watercraft 100 to elevate the bow of the watercraft 100. At this time, during the porpoising inhibiting control, the controller 20 causes the outboard motor 1 to perform the trim motion in the trim-down direction as indicated by arrow A2. Accordingly, a moment, which is generated by the thrust of the outboard motor 1 and directed to elevate the bow of the watercraft 100, is reduced in magnitude such that the moment M2 directed to elevate the bow of the watercraft 100 is canceled out. As described above, the moment M1, M2, directed to lower/elevate the bow of the watercraft 100, is reduced in magnitude by the trim motion of the outboard motor 1. Consequently, the occurrence of porpoising of the watercraft 100 is inhibited.

During the porpoising inhibiting control described above, the trim motion of the outboard motor 1 in the trim-up direction and that in the trim-down direction are equal or substantially equal in duration to each other. However, the trim motion of the outboard motor 1 in the trim-up direction and that in the trim-down direction are different in velocity from each other due to a traveling state of the watercraft 100 such as a thrust. Because of this, even when the trim motion of the outboard motor 1 in the trim-up direction and that in the trim-down direction are performed for an equal duration, it is difficult to keep the trim angle of the outboard motor 1 at a target angle. For example, as shown in FIG. 5, a median of the trim angle is likely to vary to the trim-down directional side.

Figure 7:
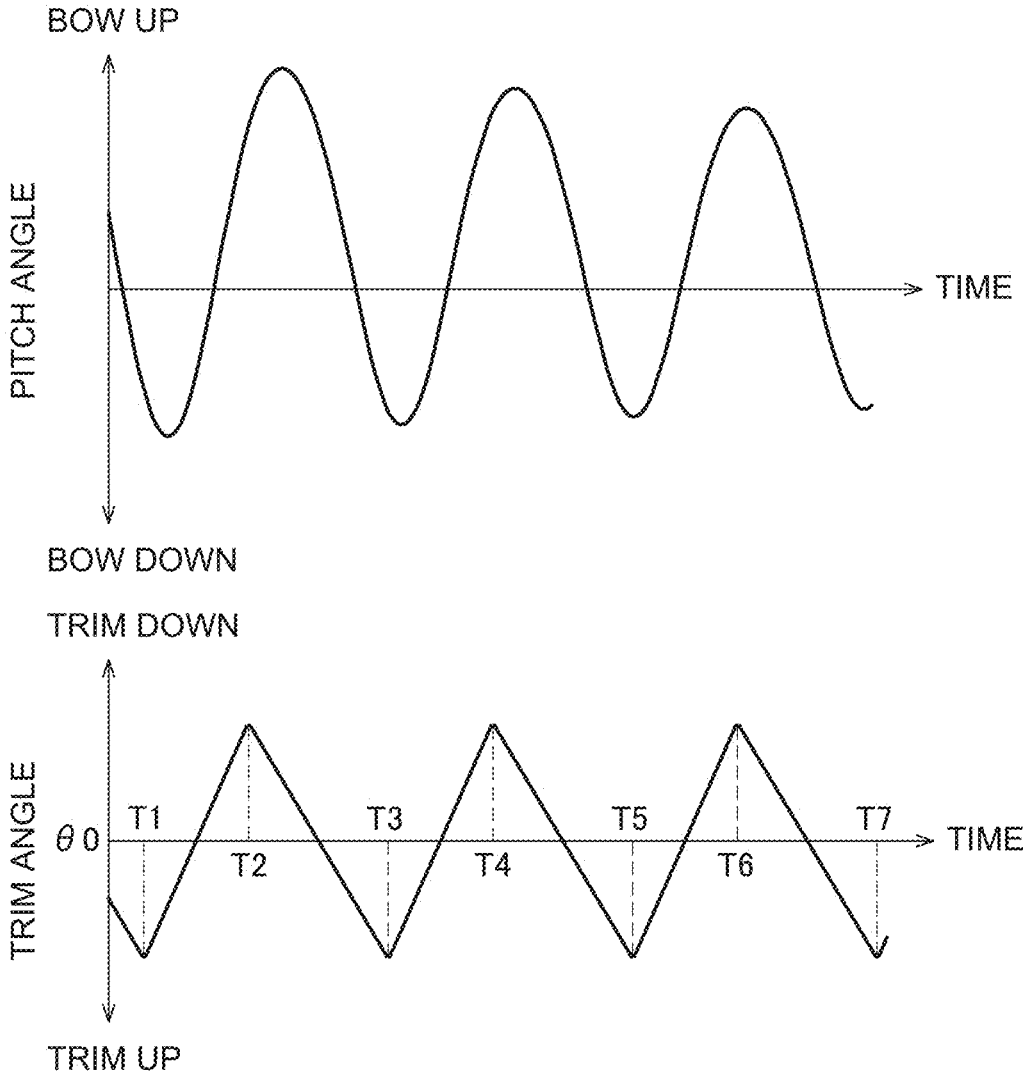
FIG. 7 includes a chart for showing a variation in a pitch angle of the watercraft during the occurrence of porpoising and a chart for showing a variation in a trim angle caused by the porpoising inhibiting control.

In view of the above, when the outboard motor 1 is caused to perform the trim motion in the trim-up direction, the controller 20 sets the duration of the trim motion to be longer than when the outboard motor 1 is caused to perform the trim motion in the trim-down direction. For example, as shown in FIG. 7, the controller 20 sets the duration T2-T3, T4-T5, T6-T7 of the trim motion in the trim-up direction to be longer than the duration T1-T2, T3-T4, T5-T6 of the trim motion in the trim-down direction. Accordingly, the median of the trim angle is kept at a target angle θ0.

Figure 8:
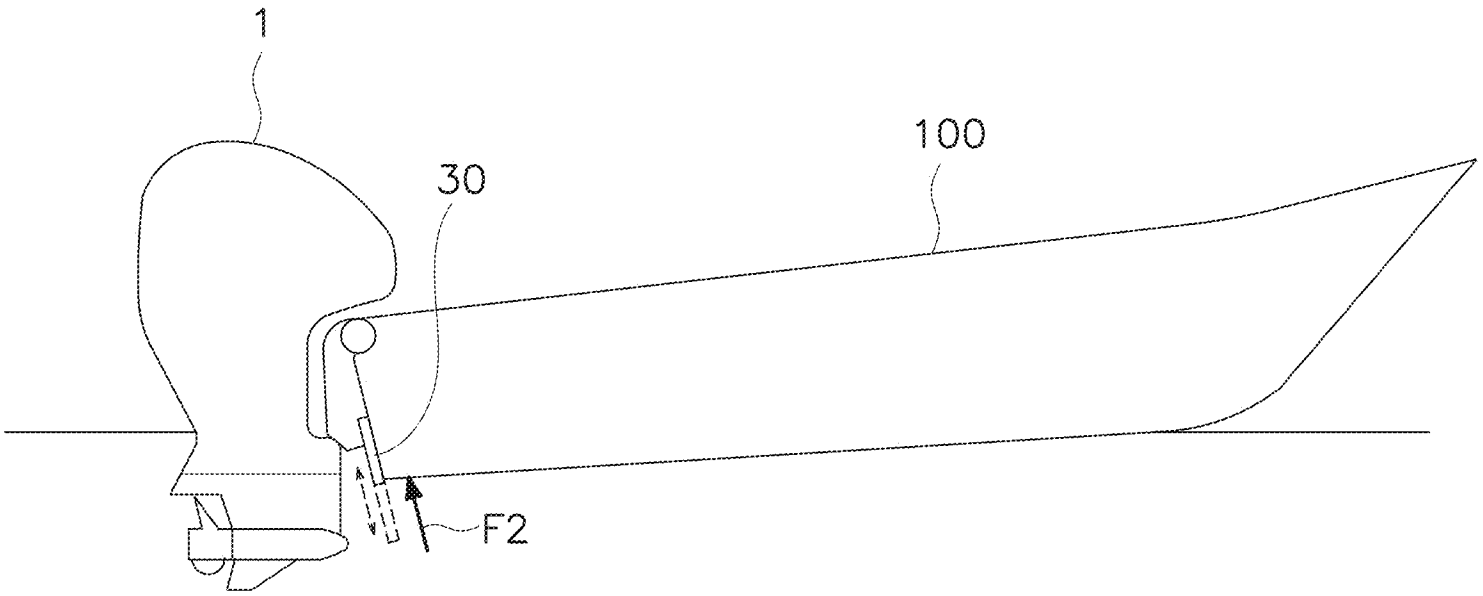
FIG. 8 is a side view showing a watercraft according to a second example embodiment of the present invention.
Figure 9:
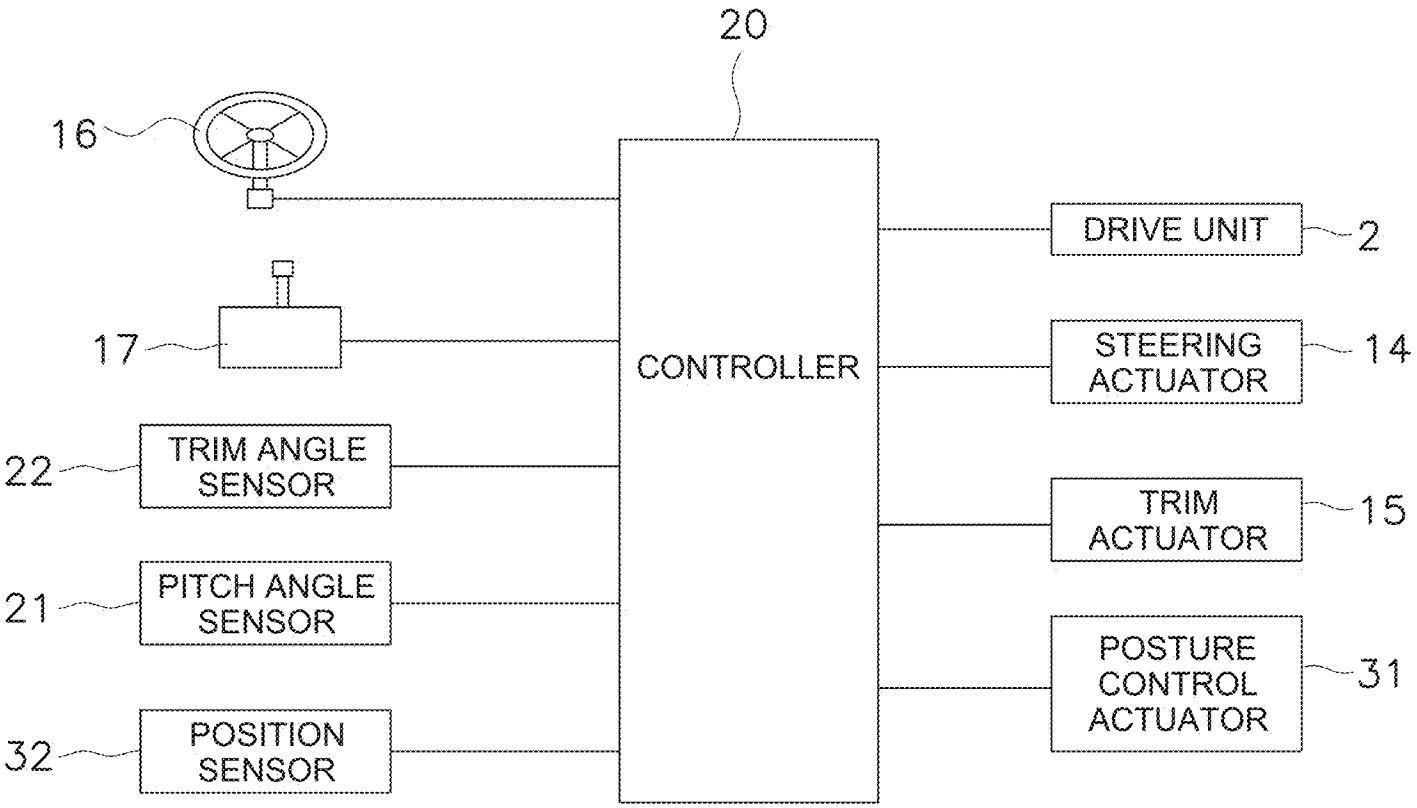
FIG. 9 is a schematic diagram showing a configuration of a watercraft control system according to the second example embodiment of the present invention.

Next, a second example embodiment of the present invention will be described. FIG. 8 is a side view showing the watercraft 100 according to the second example embodiment. FIG. 9 is a schematic diagram showing the configuration of a control system for the watercraft 100 according to the second example embodiment. As shown in FIG. 8, the watercraft 100 includes a posture control body 30. The posture control body 30 is attached to the watercraft 100 so as to be able to change the position of the posture control body 30 relative to the watercraft 100. The posture control body 30 is configured to change the lift force acting on the watercraft 100 by changing the position of the posture control body 30. The posture control body 30 is attached to the watercraft 100 so as to be able to slide up and down.

As shown in FIG. 9, the watercraft 100 includes a posture control actuator 31 and a position sensor 32. The posture control actuator 31 moves the posture control body 30 in a first increasing direction and a first decreasing direction. The first increasing direction is a direction that increases the lift force F2 acting on the stern of the watercraft 100. The second decreasing direction is a direction that decreases the lift force F2 acting on the stern of the watercraft 100. In the present example embodiment, the first increasing direction is downward and the first decreasing direction is upward. That is, by moving downward, the posture control body 30 increases the lift force F2 acting on the stern of the watercraft 100. By moving upward, the posture control body 30 reduces the lift force F2 acting on the stern of the watercraft 100.

The posture control actuator 31 is, for example, an electric motor. Alternatively, the posture control actuator 31 may be another actuator such as a hydraulic motor, a hydraulic cylinder, or an electric cylinder. The controller 20 is communicably connected to the posture control actuator 31. The controller 20 is configured or programmed to control the posture control actuator 31 to move the posture control body 30 in the first increasing direction and the first decreasing direction.

The position sensor 32 detects the position of the posture control body 30. The position of the posture control body 30 indicates the vertical position of the posture control body 30 from a predetermined reference position of the watercraft 100. The position sensor 32 outputs a position signal that indicates the position of the posture control body 30.

Figure 10:
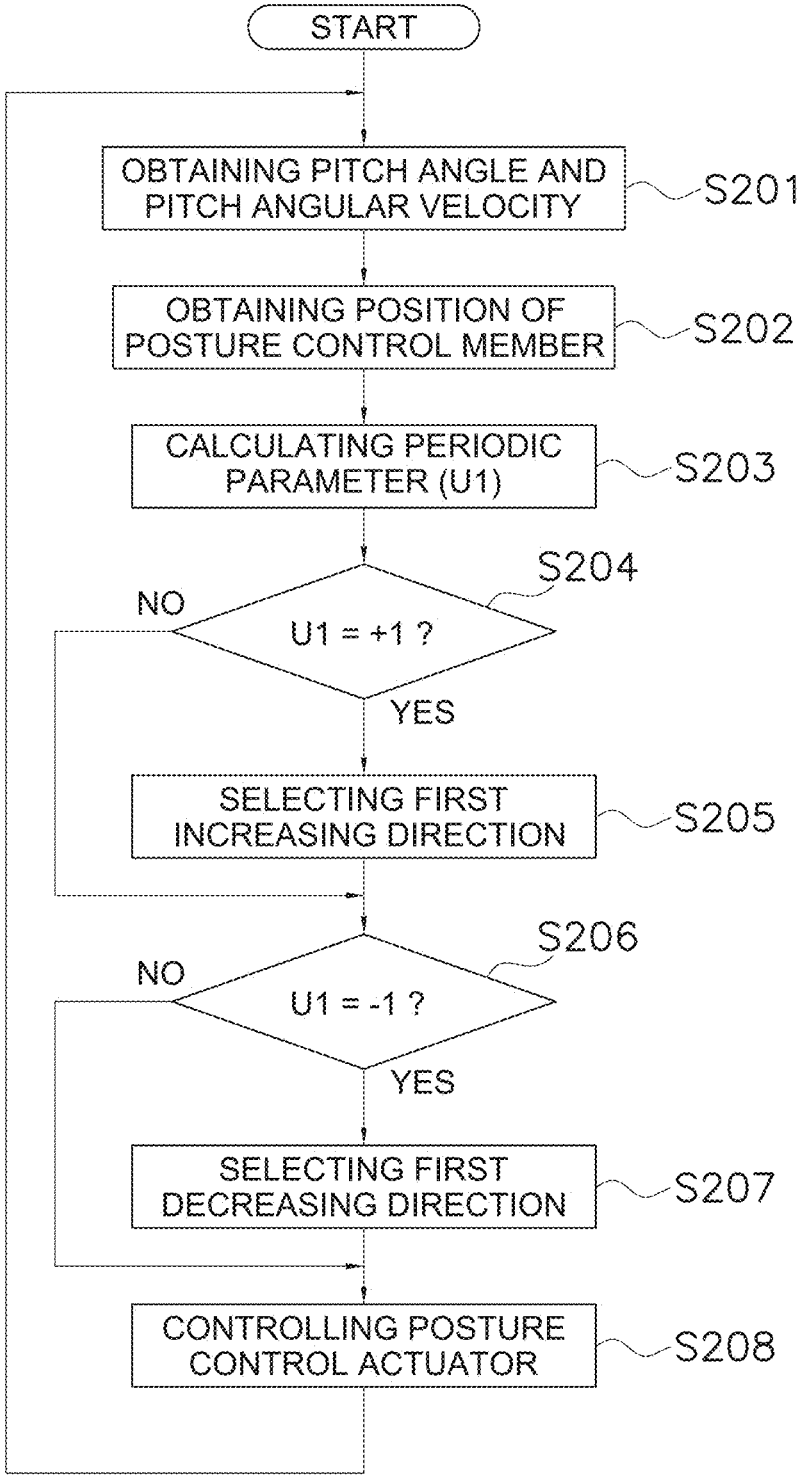
FIG. 10 is a flowchart showing a series of processes of the porpoising inhibiting control according to the second example embodiment of the present invention.

The controller 20 is configured or programmed to perform porpoising inhibiting control by controlling the movement of the posture control body 30 based on the pitch angle and the pitch angular velocity of the watercraft 100 and the position of the posture control body 30. The porpoising inhibiting control by the posture control body 30 will now be described. FIG. 10 is a flowchart showing the processes of the porpoising inhibiting control by the posture control body 30.

As shown in FIG. 10, in step S201, the controller 20 obtains the pitch angle and the pitch angular velocity, similarly to the above-described step S101. In step S202, the controller 20 obtains the position of the posture control body 30. The controller 20 receives the position signal and obtains the position of the posture control body 30 from the position signal. In step S203, the controller 20 calculates the periodic parameter in the same manner as in step S103 described above. However, the controller 20 calculates the periodic parameter using the position of the posture control body 30 instead of the trim angle described above.

In step S204, the controller 20 determines whether or not the periodic parameter is +1. When the controller 20 determines that the periodic parameter is +1, in step S205, the controller 20 sets the first increasing direction as the movement direction of the posture control body 30.

In step S206, the controller 20 determines whether or not the periodic parameter is −1. When the controller 20 determines that the periodic parameter is −1, in step S207, the controller 20 sets the first decreasing direction as the movement direction of the posture control body 30.

In step S208, the controller 20 controls the posture control actuator 31 to move the posture control body 30 in the determined movement direction. That is, when the periodic parameter is +1, the controller 20 moves the posture control body 30 in the first increasing direction. When the periodic parameter is −1, the controller 20 moves the posture control body 30 in the first decreasing direction. The controller 20 repeatedly executes the processes in step S201 to step S208.

Figure 11:
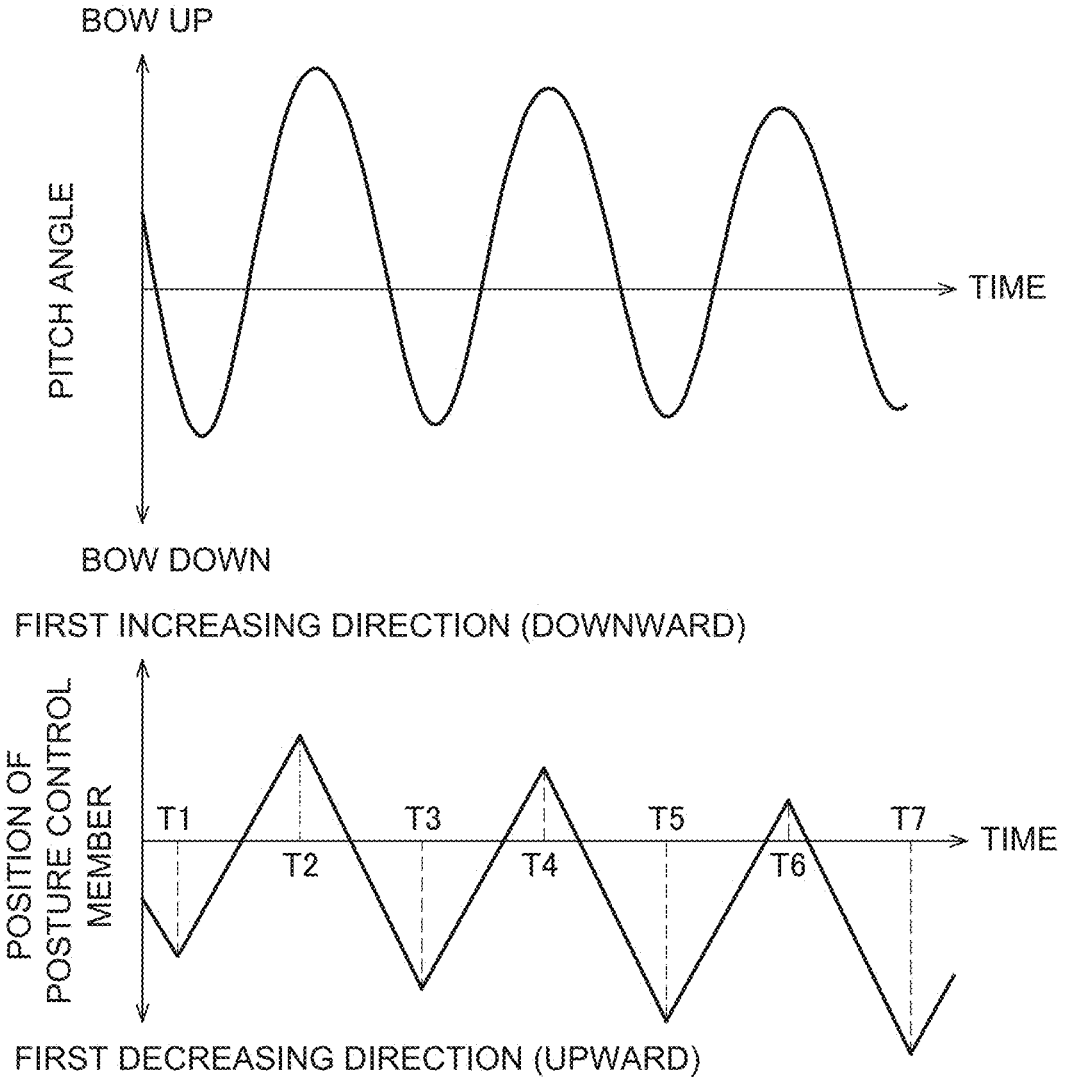
FIG. 11 includes a chart for showing a variation in the pitch angle of the watercraft during porpoising and a chart for showing a variation in a position of the posture control body due to the porpoising inhibiting control.

FIG. 11 includes a chart for showing a variation in the position of the posture control body 30 due to the porpoising inhibiting control with respect to a variation in the pitch angle of the watercraft 100 during porpoising. As shown in FIG. 11, during porpoising, the pitch angle of the watercraft 100 varies periodically. At time T1, the controller 20 determines that the periodic parameter becomes +1. As a result, the controller 20 moves the posture control body 30 in the first increasing direction, i.e., downward. The controller 20 moves the posture control body 30 in the first increasing direction from time T1 to time T2.

At time T2, the controller 20 determines that the periodic parameter becomes −1. As a result, the controller 20 moves the posture control body 30 in the first decreasing direction, that is, upward. The controller 20 moves the posture control body 30 in the first decreasing direction from time T2 to time T3.

Likewise, subsequently, the controller 20 moves the posture control body 30 in the first increasing direction from time T3 to time T4. The controller 20 moves the posture control body 30 in the first decreasing direction from time T4 to time T5. The controller 20 moves the posture control body 30 in the first increasing direction from time T5 to time T6. The controller 20 moves the posture control body 30 in the first decreasing direction from time T6 to time T7.

In the control system for the outboard motor 1 according to the second example embodiment described above, the movement direction of the posture control body 30 is set selectively to either the first increasing direction or the first decreasing direction based on the pitch angle and the pitch angular velocity of the watercraft 100, and the position of the posture control body 30. This makes it possible to accurately determine the behavior of the watercraft 100 during porpoising and to determine the movement direction of the posture control body 30. Then, the posture control body 30 is moved in the determined movement direction to alleviate the porpoising. Consequently, a reduction in the velocity of the watercraft 100 is inhibited, and simultaneously porpoising is alleviated.

Figure 12A:
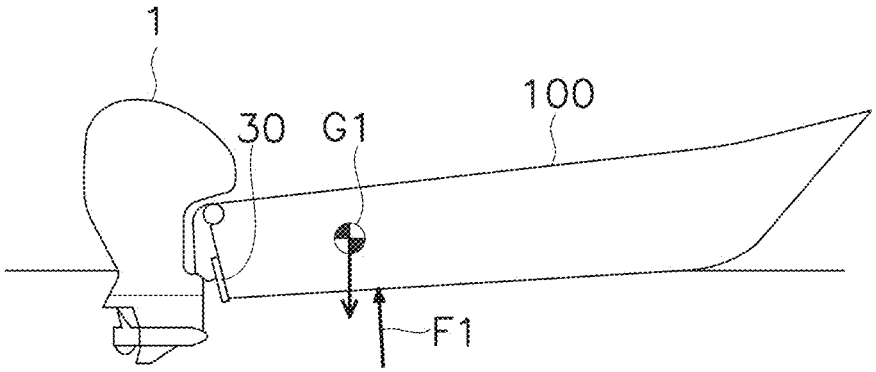
FIG. 12A is a diagram for showing an example of a behavior of the watercraft and a movement of the posture control body during porpoising.
Figure 12B:
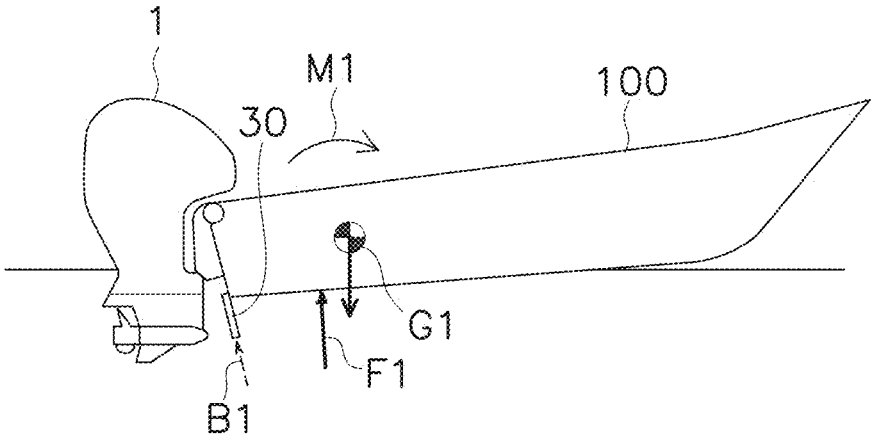
FIG. 12B is a diagram for showing an example of the behavior of the watercraft and the movement of the posture control body during porpoising.
Figure 12C:
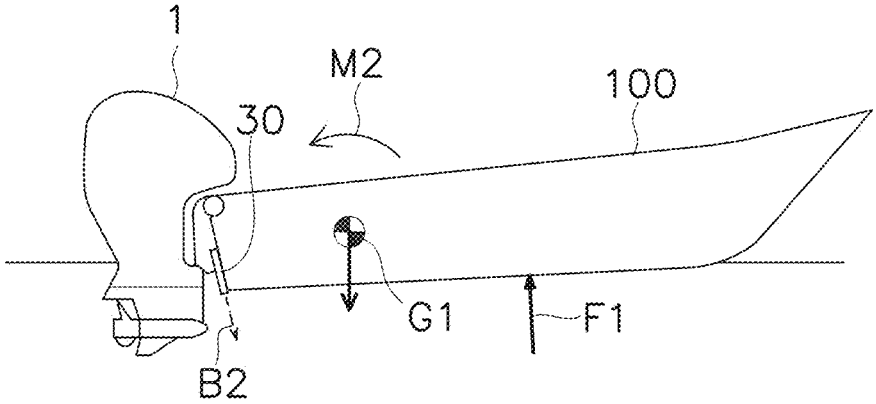
FIG. 12C is a diagram for showing an example of the behavior of the watercraft and the movement of the posture control body during porpoising.

For example, FIGS. 12A to 12C are diagrams for showing an example of the behavior of the watercraft 100 and the movement of the posture control body 30 during porpoising. As shown in FIG. 12A, during porpoising, the lift force F1 acts on a position forward of the center of gravity G1 of the watercraft 100 such that the bow of the watercraft 100 rises. As shown in FIG. 12B, when the bow rises, the position at which the lift force F1 acts moves rearward of the center of gravity G1. As a result, a moment M1 acts on the watercraft 100 in a direction that lowers the bow. At this time, the controller 20 moves the posture control body 30 in the first decreasing direction, that is, upward, as indicated by the arrow B1 through the porpoising inhibiting control. As a result, the moment in the direction of raising the bow by the lift force of the posture control body 30 becomes larger, and cancels out the moment M1 of lowering the bow.

Furthermore, as shown in FIG. 12C, when the bow lowers, the position at which the lift force F1 acts moves forward of the center of gravity G1. As a result, a moment M2 acts on the watercraft 100 in a direction that raises the bow. At this time, the controller 20 moves the posture control body 30 in the first increasing direction, that is, downward, as indicated by the arrow B2 through the porpoising inhibiting control. As a result, the moment in the direction of raising the bow by the lift force of the posture control body 30 becomes smaller, and the moment M2 of raising the bow is cancelled out. As described above, the moments M1 and M2 that raise and lower the bow are reduced by the movement of the posture control body 30. This reduces porpoising of the watercraft 100.

In the above-described porpoising inhibiting control, the movement of the posture control body 30 in the first increasing direction and that in the first decreasing direction are equal or substantially equal in duration to each other. However, the movement of the posture control body 30 in the first increasing direction and that in the first decreasing direction are different in velocity from each other due to a traveling state of the watercraft 100 such as a thrust. Therefore, even if the posture control body 30 is moved in the first increasing direction and the first decreasing direction for an equal duration, it is difficult to maintain the position of the posture control body 30 at the target position. For example, as shown in FIG. 11, the median position of the posture control body 30 tends to vary in the first decreasing direction.

Figure 13:
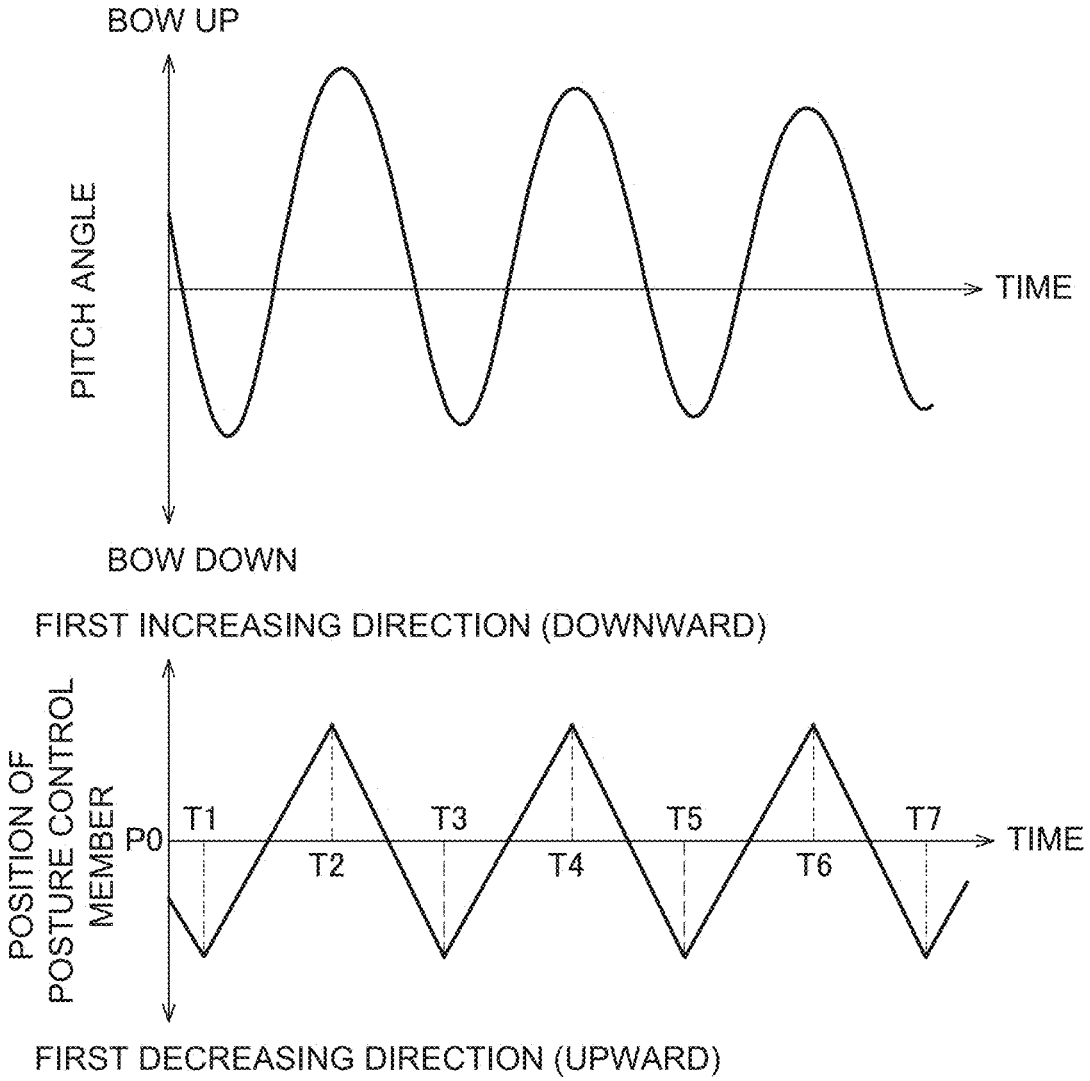
FIG. 13 includes a chart for showing a variation in the pitch angle of the watercraft during porpoising and a chart for showing a variation in the position of the posture control body due to the porpoising inhibiting control.

Therefore, when the controller 20 moves the posture control body 30 in the first increasing direction, the controller 20 sets the duration of moving the posture control body 30 to be longer than when the controller 20 moves the posture control body 30 in the first decreasing direction. For example, as shown in FIG. 13, the controller 20 sets the duration T1-T2, T3-T4, and T5-T6 for moving in the first increasing direction to be longer than the duration T2-T3, T4-T5, and T6-T7 for moving in the first decreasing direction. As a result, the median position of the posture control body 30 is maintained at the target position P0.

Example embodiments of the present invention have been explained above. However, the present invention is not limited to the example embodiments described above, and a variety of changes can be made without departing from the gist of the present invention.

Figure 14:
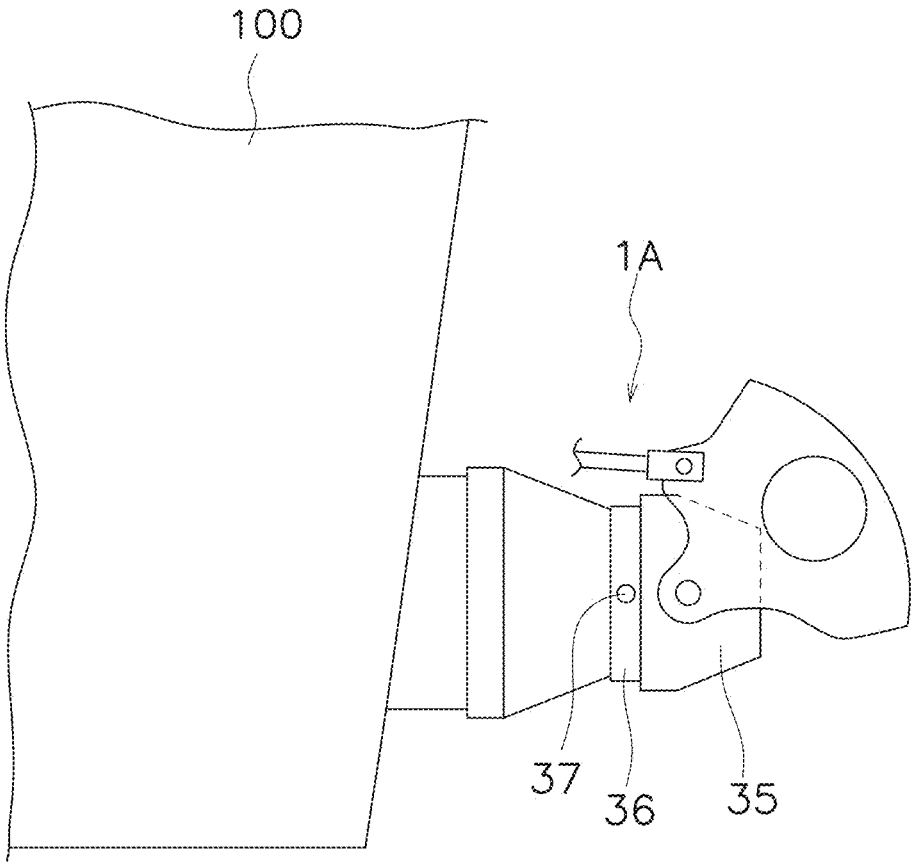
FIG. 14 is a side view showing a jet propulsion device as a marine propulsion device according to a modified example of an example embodiment of the present invention.

Instead of the outboard motor 1, another type of propulsion device such as an inboard engine outboard drive or a jet propulsion device may be used. For example, as shown in FIG. 14, a jet propulsion device 1A includes a deflector nozzle 35. The deflector nozzle 35 is supported rotatably about a trim shaft 37 via a trim ring 36. The porpoising inhibiting control may be performed by controlling the trim angle of the deflector nozzle 35 about the trim shaft 37 in the same manner as the trim angle of the outboard motor 1 of the above-described first example embodiment.

The structure of the outboard motor 1 is not limited to that in the example embodiments described above and may be changed. For example, the drive unit 2 is not limited to the internal combustion engine, and alternatively, may be an electric motor. Yet alternatively, the drive unit 2 may be a hybrid system of an internal combustion engine and an electric motor. The outboard motor 1 is not limited in number to one. The outboard motor 1 may be two or more in number.

Figure 15:
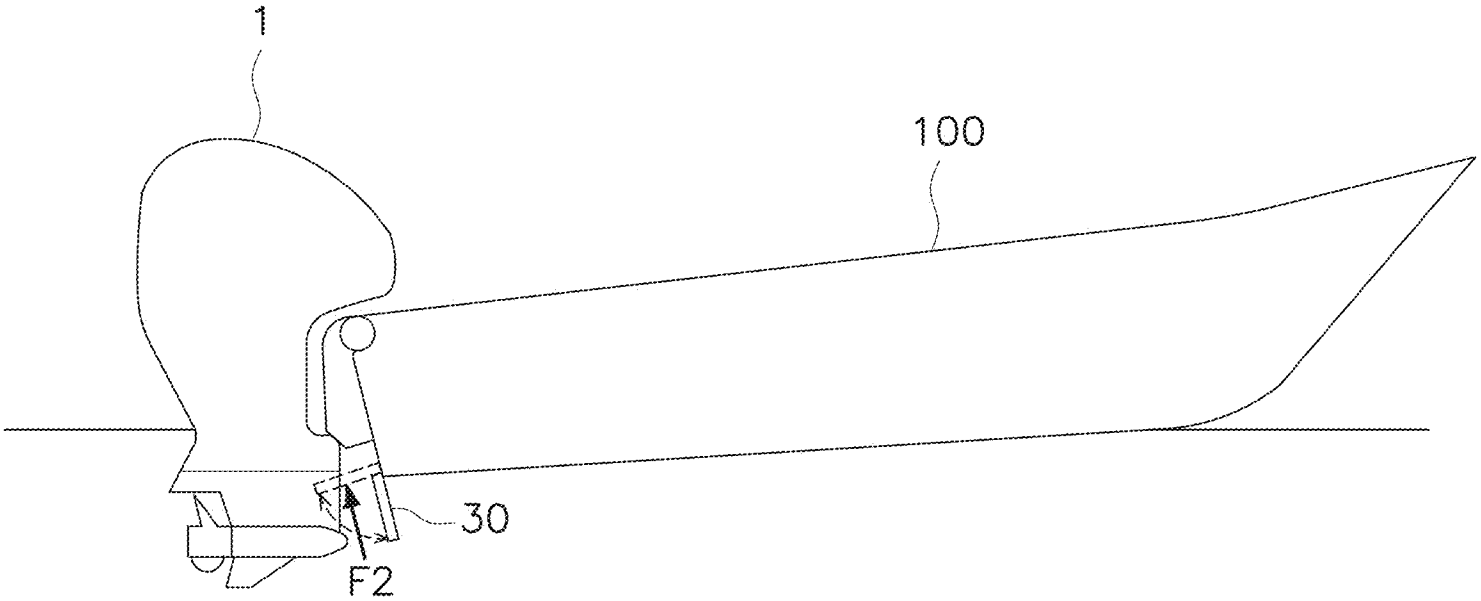
FIG. 15 is a side view of a watercraft showing a posture control body according to a modified example of an example embodiment of the present invention.

The movement of the posture control body 30 is not limited to a sliding movement, and may be another movement. For example, as shown in FIG. 15, the posture control body 30 may be attached to the watercraft 100 so as to be rotatable up and down. In this case, the position sensor 32 may detect the rotation angle of the posture control body 30 from a predetermined reference direction (for example, the vertical direction) as the position of the posture control body 30. In this case, the first increasing direction is a direction in which the posture control body 30 rotates downward. The first decreasing direction is a direction in which the posture control body 30 rotates upward.

The posture control body 30 may be, for example, an interceptor. Alternatively, the posture control body 30 may be another structure such as a trim tab or a hydrofoil. The shape of the posture control body 30 is not limited to a plate shape, and may be another shape.

The periodic parameter is not limited to that in the example embodiments described above and may be changed. For example, in the example embodiments described above, the periodic parameter includes the pitch angle of the watercraft 100, the pitch angular velocity thereof, and the trim angle of the outboard motor 1. However, the pitch angle of the watercraft 100 may be omitted from the periodic parameter. Alternatively, the pitch angular velocity may be omitted from the periodic parameter. Another variable may be added to the periodic parameter. The magnitude in amplitude of the periodic parameter as an absolute value is not limited to 1 and may be another numeric value.

The porpoising inhibiting control by the marine propulsion device and the porpoising inhibiting control by the posture control body 30 may be used in combination. The trim-up direction A1 of the outboard motor 1 in the first example embodiment described above is a direction for reducing the lift force F2 acting on the stern (hereinafter referred to as the second decreasing direction). The trim-down direction A2 of the outboard motor 1 in the first example embodiment described above is a direction that increases the lift force F2 acting on the stern (hereinafter referred to as the second increasing direction).

Figure 16A:
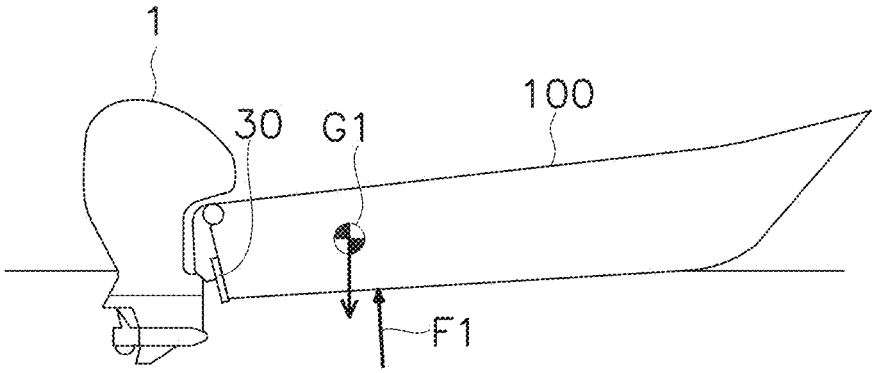
FIG. 16A is a diagram showing an example of the behavior of the watercraft, the trim motion of the outboard motor, and the movement of the posture control body during porpoising.
Figure 16B:
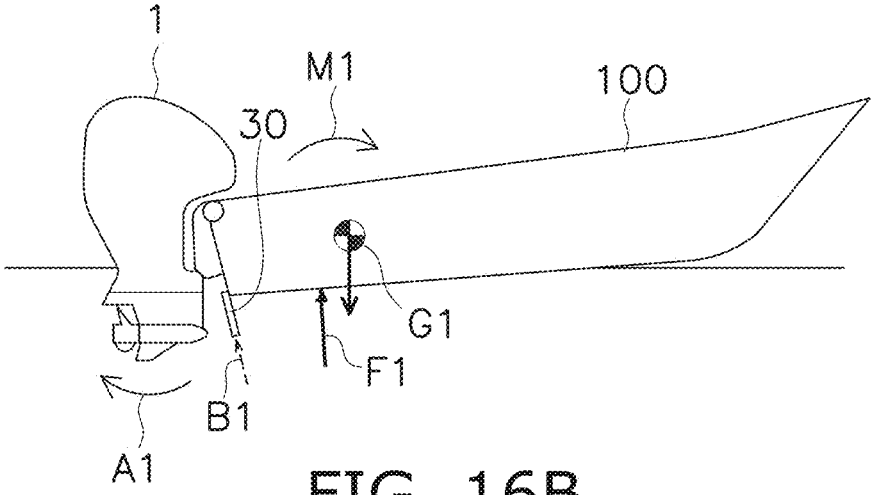
FIG. 16B is a diagram showing an example of the behavior of the watercraft, the trim motion of the outboard motor, and the movement of the posture control body during porpoising.
Figure 16C:
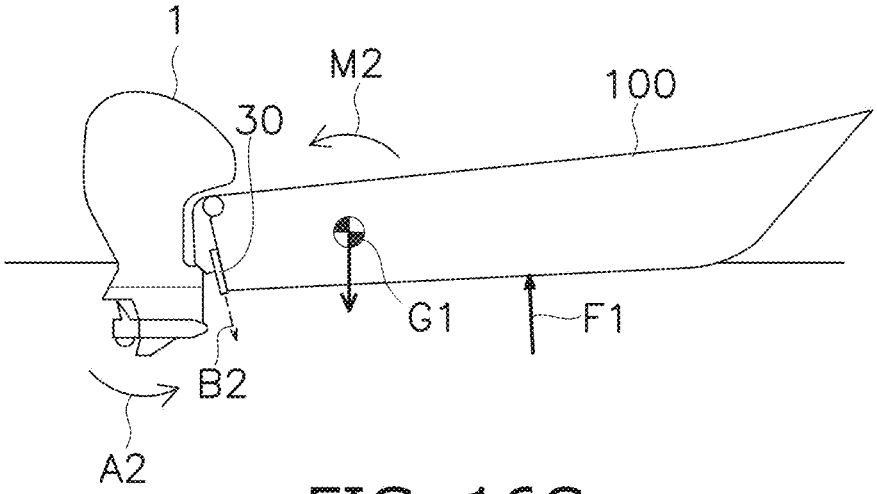
FIG. 16C is a diagram showing an example of the behavior of the watercraft, the trim motion of the outboard motor, and the movement of the posture control body during porpoising.

For example, as shown in FIGS. 16A to 16C, the controller 20 may simultaneously execute the porpoising inhibiting control by the outboard motor 1 and the porpoising inhibiting control by the posture control body 30. For example, when the controller 20 determines that the periodic parameter is −1, as shown in FIG. 16B, the controller 20 may move the outboard motor 1 in the second decreasing direction A1 and move the posture control body 30 in the first decreasing direction B1. When the controller 20 determines that the periodic parameter is +1, as shown in FIG. 16C, the controller 20 may move the outboard motor 1 in the second increasing direction A2 and may move the posture control body 30 in the first increasing direction B2.

Alternatively, the controller 20 may selectively execute the porpoising inhibiting control by the marine propulsion device and the porpoising inhibiting control by the posture control body 30. For example, the controller 20 may execute the porpoising inhibiting control by the posture control body 30 and determine whether the fluctuation of the pitch angle has become sufficiently small. When the controller 20 determines that the fluctuation of the pitch angle has not been sufficiently reduced, the controller 20 may execute the porpoising inhibiting control by the marine propulsion device.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a behavior of a watercraft, the system comprising:

a marine propulsion device including a trim shaft and that is pivotably attachable to the watercraft about the trim shaft;

an actuator to cause the marine propulsion device to perform a trim motion in a trim-up direction and a trim-down direction by causing the marine propulsion device to pivot about the trim shaft;

a sensor to detect motion information indicating an up-and-down directional motion of a bow of the watercraft; and a controller communicably connected to the actuator and configured or programmed to:

obtain the motion information;

selectively set either the trim-up direction or the trim-down direction as a trim direction in accordance with the up-and-down directional motion of the bow based on the motion information;

control the actuator to cause the marine propulsion device to perform the trim motion in the trim direction; and set a duration of the trim motion to be different between when the marine propulsion device is caused to perform the trim motion in the trim-up direction and when the marine propulsion device is caused to perform the trim motion in the trim-down direction.

2. The system according to claim 1, wherein the controller is configured or programmed to set the duration of the trim motion to be longer when the marine propulsion device is caused to perform the trim motion in the trim-up direction than when the marine propulsion device is caused to perform the trim motion in the trim-down direction.

3. The system according to claim 1, wherein the motion information includes a trim angle of the marine propulsion device and at least either of a pitch angle of the watercraft or an angular velocity of the pitch angle; and the controller is configured or programmed to selectively set either the trim-up direction or the trim-down direction as the trim direction based on the trim angle of the marine propulsion device and at least either of the pitch angle of the watercraft or the angular velocity of the pitch angle.

4. A system for controlling a behavior of a watercraft, the system comprising:

a posture control body attachable to the watercraft and adjustable to change a position of the posture control body relative to the watercraft and configured to change a lift force acting on the watercraft by changing the position of the posture control body;

a first actuator to move the posture control body in a first increasing direction to increase the lift force and in a first decreasing direction to decrease the lift force;

a sensor to detect motion information indicating an up-and-down directional motion of a bow of the watercraft; and a controller communicably connected to the first actuator and configured or programmed to:

obtain the motion information;

selectively set either the first increasing direction or the first decreasing direction as a movement direction of the posture control body in accordance with the up-and-down directional motion of the bow based on the motion information;

control the first actuator to move the posture control body in the movement direction; and set a duration of moving the posture control body to be different between when the posture control body moves in the first increasing direction and when the posture control body moves in the first decreasing direction.

5. The system according to claim 4, wherein the controller is configured or programmed to set the duration of moving the posture control body to be longer when moving the posture control body in the first increasing direction than when moving the posture control body in the first decreasing direction.

6. The system according to claim 4, wherein the motion information includes a position of the posture control body and at least either of a pitch angle of the watercraft or an angular velocity of the pitch angle; and the controller is configured or programmed to selectively set either the first increasing direction or the first decreasing direction as the movement direction of the posture control body based on the position of the posture control body and at least either of the pitch angle of the watercraft or the angular velocity of the pitch angle.

7. The system according to claim 4, further comprising:

a marine propulsion device attachable to the watercraft and adjustable to change a position of the marine propulsion device relative to the watercraft; and a second actuator to move the marine propulsion device in a second increasing direction to increase the lift force and in a second decreasing direction to decrease the lift force; wherein the controller is configured or programmed to:

selectively set either the second increasing direction or the second decreasing direction as a movement direction of the marine propulsion device in accordance with the up-and-down directional motion of the bow based on the motion information; and control the second actuator to move the marine propulsion device in the movement direction.

8. The system according to claim 7, wherein the controller is configured or programmed to set a duration of moving the marine propulsion device to be different between when moving the marine propulsion device in the second increasing direction and when moving the marine propulsion device in the second decreasing direction.

9. The system according to claim 8, wherein the controller is configured or programmed to set the duration to be longer when moving the marine propulsion device in the second decreasing direction than when moving the marine propulsion device in the second increasing direction.

10. The system according to claim 4, wherein the motion information includes a position of the marine propulsion device and at least either of a pitch angle of the watercraft or an angular velocity of the pitch angle; and the controller is configured or programmed to selectively set either the second increasing direction or the second decreasing direction as a movement direction of the marine propulsion device based on the position of the marine propulsion device and at least either of the pitch angle of the watercraft or the angular velocity of the pitch angle.

11. A system for controlling a behavior of a watercraft, the system comprising:

a posture control body attachable to the watercraft and adjustable to change a position of the posture control body relative to the watercraft and configured to change a lift force acting on the watercraft by changing the position of the posture control body;

a first actuator to move the posture control body in a first increasing direction to increase the lift force and in a first decreasing direction to decrease the lift force;

a marine propulsion device attachable to the watercraft and adjustable to change a position of the marine propulsion device relative to the watercraft;

a second actuator to move the marine propulsion device in a second increasing direction to increase the lift force and in a second decreasing direction to decrease the lift force;

a sensor to detect motion information indicating an up-and-down directional motion of a bow of the watercraft; and a controller communicably connected to the first actuator and the second actuator and configured or programmed to:

obtain the motion information;

move at least either of the posture control body or the marine propulsion device to alleviate porpoising of the watercraft;

selectively set either the first increasing direction or the first decreasing direction as a movement direction of the posture control body in accordance with the up-and-down directional motion of the bow, and control the first actuator to move the posture control body in the movement direction when moving the posture control body;

selectively set either the second increasing direction or the second decreasing direction as a movement direction of the marine propulsion device in accordance with the up-and-down directional motion of the bow, and control the second actuator to move the marine propulsion device in the movement direction when moving the marine propulsion device;

set a duration of moving the posture control body to be different between when the posture control body moves in the first increasing direction and when the posture control body moves in the first decreasing direction; and set a duration of moving the marine propulsion device to be different between when the marine propulsion device moves in the second increasing direction and when the marine propulsion device moves in the second decreasing direction.

12. The system according to claim 11, wherein the controller is configured or programmed to:

set the duration of moving the posture control body to be longer when the posture control body moves in the first increasing direction than when the posture control body moves in the first decreasing direction; and set the duration of moving the marine propulsion device to be longer when the marine propulsion device moves in the second decreasing direction than when the marine propulsion device moves in the second increasing direction.

13. The system according to claim 11, wherein the motion information includes at least either of a position of the posture control body or a position of the marine propulsion device, and at least either of a pitch angle of the watercraft or an angular velocity of the pitch angle;

the controller is configured or programmed to:

selectively set either the first increasing direction or the first decreasing direction as a movement direction of the posture control body based on the position of the posture control body and at least either of the pitch angle of the watercraft or the angular velocity of the pitch angle when moving the posture control body; and selectively set either the second increasing direction or the second decreasing direction as a movement direction of the marine propulsion device based on the position of the marine propulsion device and at least either of the pitch angle of the watercraft or the angular velocity of the pitch angle when moving the marine propulsion device.

* * * * *